United States Patent [19]

Dean et al.

[11] Patent Number: 4,586,362

[45] Date of Patent: May 6, 1986

[54] BLIND RIVETING MACHINE

[75] Inventors: Sidney Dean, Sutton Coldfield; John G. Butcher, Birmingham, both of England

[73] Assignee: USM Corporation, Farmington, Conn.

[21] Appl. No.: 740,422

[22] Filed: Jun. 3, 1985

[30] Foreign Application Priority Data

Jun. 5, 1984 [GB] United Kingdom ..... 8414349

[51] Int. Cl.[4] ..... B21D 31/00

[52] U.S. Cl. ..... 72/391; 227/112

[58] Field of Search ..... 72/391, 463, 114; 29/243.53; 227/112, 116

[56] References Cited

U.S. PATENT DOCUMENTS

| | | | |
|---|---|---|---|
| 3,647,129 | 3/1972 | Ehrlich | 227/112 |
| 3,658,230 | 4/1972 | Enoch | 227/112 |
| 3,672,029 | 6/1972 | Butress | 227/112 |
| 4,310,056 | 1/1982 | Olsson | 72/391 |
| 4,515,005 | 5/1985 | Klein | 72/391 |

*Primary Examiner*—Leon Gilden

*Attorney, Agent, or Firm*—Alan N. McCartney

[57] ABSTRACT

A blind-riveting machine having a device for presenting blind-riveting assemblies to the nosepiece of a rivet setting head. The presenting device comprises a chamber with flat parallel side walls bounded by arcuate walls leading from an inlet 60 at one end to a gate member to arrest blind-riveting assemblies at the other.

5 Claims, 3 Drawing Figures

BLIND RIVETING MACHINE

BACKGROUND OF THE INVENTION

1. Field of the Invention

This invention is concerned with a blind-riveting machine comprising a device for presenting a blind-riveting assembly to a nosepiece of a rivet-setting head of the machine, 2. Summary of the Prior Art The expression "blind-riveting assembly" is used herein to denote an assembly of a type comprising a hollow rivet and a mandrel, the mandrel having a head and a stem, part of which lies within a tubular portion of the rivet and part of which projects from one end of the rivet, the mandrel being too large to pass through the tubular portion of the rivet without deforming it. This arrangement is being such that after the tubular portion of the rivet has been inserted into an opening in a workpiece, the rivet can be set by pulling on the mandrel stem to cause the mandrel head to effect radial expansion of the tubular portion at the other side of the workpiece. Usually, in blind-riveting using a blind-riveting assembly, the rivet has a head at that end from which the mandrel stem projects, and to set the rivet use is made of a rivet-setting device comprising a nosepiece, which has a bore to receive the projecting part of the mandrel stem and provides an abutment to engage the rivet head and hold it against bodily movement relative to the workpiece during setting. A mandrel-pulling means pulls the projecting part of the mandrel stem along a longitudinal axis of the rivet-setting device coaxial with the bore in the nosepiece.

In U.S. Pat. No. 3,658,230 there is described a blind-riveting machine comprising a pivotally mounted rivet-setting head arranged to reciprocate towards and away from a work support, and to assume, upon retraction and rotation through an arc, a position with respect to a presenting device such that a blind-riveting assembly projected through a gate of the presenting device will be received in a bore in the nosepiece of the rivet-setting head.

SUMMARY OF THE INVENTION

It is an object of the invention to provide a blind-riveting machine with improved means for presenting blind-riveting assemblies to a rivet-setting head of the machine.

This invention provides a blind-riveting machine comprising a device for presenting a blind-riveting assembly to a nosepiece of a rivet-setting head of the machine. The presenting device comprises holding means to arrest and hold assemblies fed thereto one at a time mandrel stem foremost. Means are provided for bringing a bore in the nosepiece of the rivet-setting head in alignment with the holding means of the presenting device in order that the mandrel stem of an assembly is fed into the bore of the nosepiece. Means is also provided for causing relative displacement to take place between the rivet-setting head and the presenting device so that an assembly released by the holding means is exposed for insertion into a workpiece. The presenting device is provided with a chamber bounded on two opposite sides by flat walls spanned by a curved wall leading from an inlet at one end of the chamber to said holding means and at an outlet at the other, whereby assemblies change their direction of travel as they slide along the curved wall from the inlet to the outlet.

The holding means of a machine in accordance with the invention may be constituted by a gate comprising spring-pressed members separable by the rivet head to release the blind-riveting assembly when relative movement transverse to the mandrel takes place with the assembly held by said nosepiece of the rivet-setting head. The machine may have a carriage which carries a plurality of chambers disposed side by side with the holding means spaced in a row for simultaneous transfer of blind-riveting assemblies to a similarly disposed array of nosepieces, and the carriage may be arranged to reciprocate along a path parallel to the side walls of the chambers. The curved wall spanning the side walls of the chamber or chambers may be arcuate. The side walls of the chamber may be parallel.

A rivet-setting head of a machine in accordance with the invention may remain stationary in the operation of the machine or may be arranged to move between a blind-riveting assembly receiving position and a rivet-setting locality.

There now follows a detailed description, to be read with reference to the accompanying drawings, of a blind-riveting assembly presenting device of a blind-riveting machine in accordance with the invention and illustrative thereof. This illustrative machine has been selected for description by way of example and not of limitation of the invention.

DESCRIPTION OF THE PREFERRED EMBODIMENT

Figure 1:
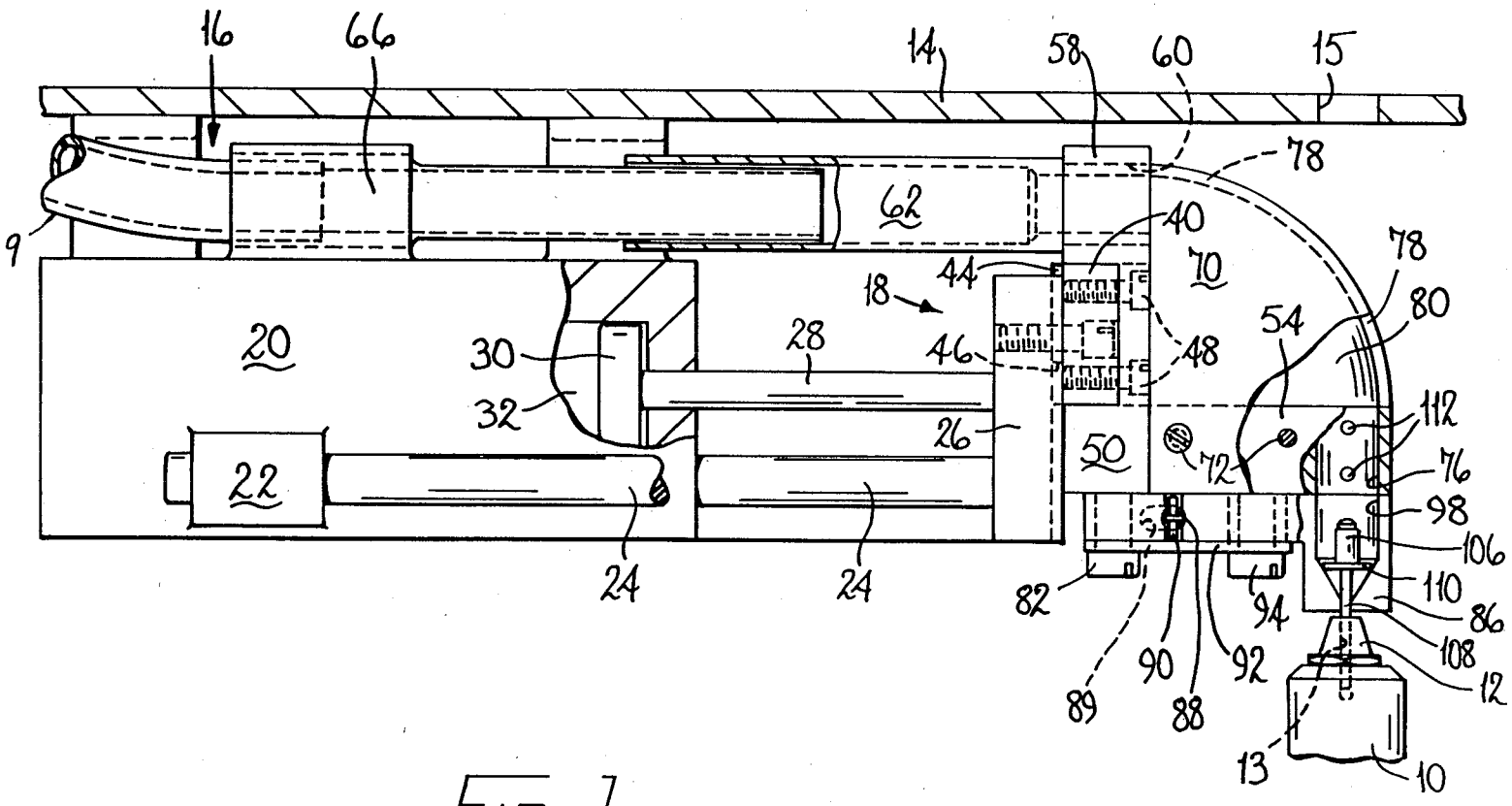
FIG. 1 is a fragmentary view in side elevation and partly in section of a presenting device of the illustrative machine.
Figure 2:
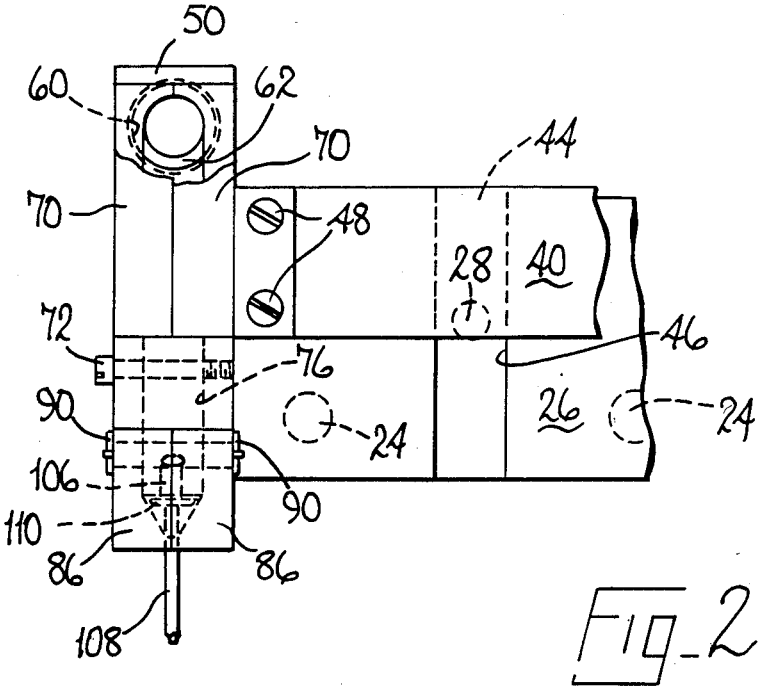
FIG. 2 is a front view of parts shown in FIG. 1.
Figure 3:
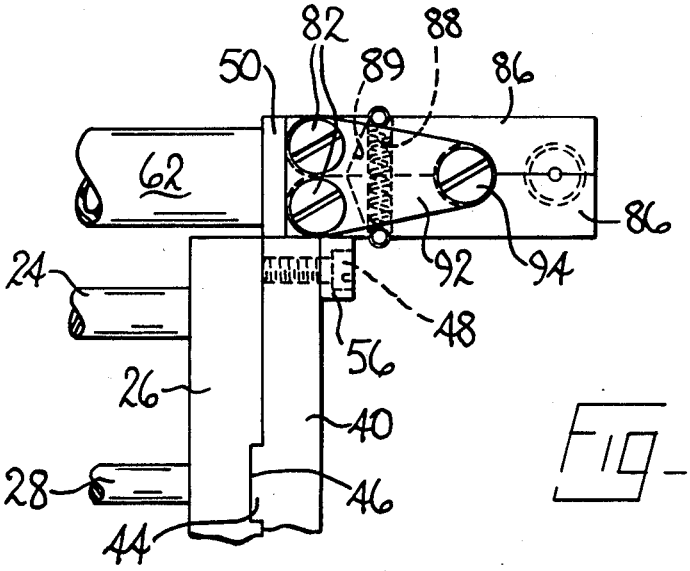
FIG. 3 depicts parts shown in FIG. 2 as seen from below in the direction of the arrow III.

Referring to FIG. 1, the illustrative machine is mounted on a bench (not shown) below a table top 14 and comprises a rivet-setting head 10 including an upwardly facing nosepiece 12, with a bore 13 in it, of conventional construction. The head 10 is mounted for vertical reciprocation on the bench and will not be further described herein. The table top 14 provides a work support with a hole 15 for reception of the nosepiece 12 when the rivet-setting head 10 is in an uppermost, rivet-setting position. The machine also comprises a conventional hopper and raceway (not shown) for delivering blind-riveting assemblies mandrel stem foremost one at a time to be blown along a hose 9 as initiated by a separator (not shown) when actuated in the operation of the machine.

The illustrative machine comprises a blind-riveting assembly presenting device shown generally at 16 in FIG. 1 including a carriage 18 and a cylinder block 20 suspended from the table top 14. The block 20 provides guide lugs 22, one at each side, for horizontal guide rods 24 of the carriage 18 which has a vertical wall 26 fixed to front ends of the rods 24. A piston rod 28 projecting rearwardly from the wall 26, to which it is secured, is effective to move the carriage back and forth under the influence of a piston 30 operating in a pneumatic cylinder 32 provided in the block 20.

On the front of the wall 26 of the carriage 18, a horizontal bar 40 is mounted transverse to the direction of the piston 28, being secured by bolts 42 (one only of which is visible in the drawings). A vertical rib 44 on the rear of the bar 40 is accomodated in a vertical groove 46 in the wall. Provision may be made for adjusting the relative heightwise dispositions of the bar 40 and rivet-setting head 10. To the front of the bar 40 is secured by bolts 48 an upright L-shaped bracket 50, a horizontal groove 52 on the rear side of an upright leg 58 of the bracket 50 embracing the bar 40 and a narrow horizontal leg 54 of the bracket projecting forwardly (i.e. to the right in FIG. 1). The bolts 48 pass through a lug 56 on the side of the upright leg 58 of the bracket 50. In an upper portion of the upright leg 58 of the bracket 50 is a bore 60 which receives a forward end portion of a tubular sleeve 62 which slideably accommodates a forwardly projecting tube 64 secured in a bore in a horizontal bar 66 mounted on top of the cylinder 32. The hose 9 passes into the rear end of the tube 64, where it is secured. Thus, a blind-riveting assembly leaving the hose 9 passes along the tube 64 and sleeve 62 and through the bore 60. When the piston 30 moves in the cylinder 32, the sleeve moves correspondingly over the tube 64.

On either side of the narrow leg 54 of the bracket 50 of the carriage 18, a flat side wall 70 is secured by bolts 72. The wall 70 abuts the front of the upstanding leg 58 of the bracket and each wall 70 has an arcuate periphery 74 which extends through 90° from the upper end of the leg 58 bounding the bore 60 to the front of the leg 54, through which there is a vertical bore 76 of the same diameter as the inside of the sleeve 62 where it lies in the bore 60. Along the periphery 74 of the two walls 70 are inwardly projecting arcuate flanges 78 which abut one another along a central vertical plane of the bracket 50. The walls 70 are parallel and define, with the bracket 50, a narrow flat sided chamber 80. The width of the chamber 80 is the same as the diameter of the bore 76.

The horizontal leg 54 of the bracket 50 is flat on its under side, and gate members 86 are mounted thereon by two vertical pivot pins 82. The gate members 86 are urged together by a tension spring 88 accommodated in slots 89 through the members 86 and held in place by retaining pins 90. A retaining plate 92 holds the gate members 86 in place, being itself secured by heads of the pivot pins 82 and by a bolt 94. The gate members 86 are shaped so that, when closed together, they embrace the bolt 94 and provide at their forward ends a vertical passage 98 as a continuation of the bore 76. The passage 98 has a cylindrical upper part 100, below which is a conical part 102 leading to a lower part 104 of a smaller diameter to closely embrace the mandrel stems. A blind-riveting assembly comprising a rivet 106 and a mandrel 108 is shown in FIG. 1; the rivet has a head 110.

Conveniently, in a cycle of operation of the illustrative machine, the carriage 18 of the presenting device, absent a blind-riveting assembly, advances from a retracted position to the advanced, delivery, position shown in FIG. 1. In this position the lower part 104 of the passage 98 defined by the gate members 86 is in alignment with the bore 13 in the nosepiece 12, the rivet-setting head 10 being in its lowermost, assembly receiving, position. A blind-riveting assembly is now released mandrel stem leading for travel through the hose 9, tube 64, sleeve 62, chamber 80, bore 76 and passage 98. The arcuate flanges 78 guide the assembly as it changes its direction of travel and the walls of the passage 98 direct the assembly so that the mandrel stem is introduced into the nosepiece 12. The chamber 80, in which the blind-riveting assembly is not confined by an arcuate wall on the inside of its curved path of travel, enables the assembly to follow an arcuate path of smaller radius that can usually be readily obtained by means of a flexible hose; thus the rivet-setting head when in its assembly-receiving position is only a short distance (as seen in FIG. 1) below the table top 14. Moreoever, the carriage 18 needs to travel only a short horizontal distance between its advanced position over the nosepiece 12 and a retracted position to allow the rivet-setting head 10 to move up in front of it. The width of the chamber and the diameter of the bore 76 freely accommodate the rivet head, the assembly sliding readily along the flanges 78 and through the bore 76 to come to rest in the passage 98 with its rivet head 110 on the conical part 104 and the stem of the mandrel 108 in the nosepiece. Holes 112 in the side of the bore 76 allow air to escape to atmosphere and thus ensure free flow through the bore 76 and chamber 80. Thus presented to the nosepiece 12, the assembly remains there with mandrel 108 held in the bore 13 while the carriage retracts transversely of the mandrel stem, the gate members 86 pivoting open as they slide over the rivet head 110. As soon as the carriage 18 has retracted clear of the vertical path of the head 10, the head 10 moves up to introduce the nosepiece 12 into the hole 15 in the table top 14, where the rivet 106 is exposed for insertion into a workpiece. The rivet is then set by operation of the head 10.

Whereas the illustrative machine has been described with only one nosepiece 12 and chamber 80, two or more delivery arrangements, each comprising a hose 9, tube 64, sleeve 62, chamber 80, bore 76, and gate members 86 can be mounted side by side on the wall 40 of the carriage, to deliver assemblies simultaneously to correspondingly spaced nosepieces of a rivet-setting head.

Whereas, also, the illustrative machine has been described with a rivet-setting head 10 fixedly mounted on the bench, a machine in accordance with the invention may be arranged to present assemblies to a rivet-setting head which is itself movable between assembly receiving and rivet setting positions. Also, the rivet-setting head may be disposed with it nosepiece otherwise than facing upwardly, in which case the head is preferably connected to a vacuum source to provide a rearward flow of air through the nosepiece to hold a blind-riveting assembly against falling out.

The presenting device 16 of the illustrative machine is of simple construction, economical to manufacture, fast and reliable in operation, and compact. It is thus very suitable for use in blind riveting on automatically supplied assembly lines, especially where space is restricted and more than one rivet may be required to be set at a time.

We claim:

1. A blind-riveting machine comprising a device for presenting a blind-riveting assembly to a nosepiece of a rivet-setting head of the machine, the presenting device comprising holding means to rest and releasably hold assemblies fed thereto one at a time mandrel stem foremost in the operation of the machine, means for bringing a bore in said nosepiece of the rivet-setting head and said holding means of the presenting device into alignment with one another in order that the mandrel stem of an assembly fed to the holding means can pass into the bore of the nosepiece, and means for causing relative displacement to take place between the rivet-setting head and the presenting device so that the assembly released by the holding means is exposed for insertion into a workpiece, the presenting device providing a chamber bounded on two opposite sides by flat walls and spanned by a curved wall leading from an inlet at one end of the chamber to said holding means at an outlet at the other, whereby assemblies change their direction of travel as they slide along the curved wall from the inlet to the outlet.

2. Machine according to claim 1 in which the holding means comprises spring-pressed members separable by the rivet head to release a blind-riveting assembly when relative movement transverse to the mandrel stem takes place with the assembly held by said nosepiece of the rivet-setting head.

3. A machine according to either one of claim 1 and 2 comprising a plurality of chambers for changing the direction of travel of the assemblies disposed side by side with the holding means spaced in a row for simultaneous transfer of blind-riveting assemblies to a similarly disposed array of nosepieces.

4. A machine according to claim 3 in which said plurality of chambers are provided on a common carriage for movement towards and away from an assembly presenting locality.

5. A machine according to claim 4 including means for reciprocating a carriage of the presenting device along a path parallel to the side walls of said chamber and transverse to the axis of the bore in the nosepiece.

* * * * *